US011179282B2

(12) United States Patent
Menna et al.

(10) Patent No.: US 11,179,282 B2
(45) Date of Patent: Nov. 23, 2021

(54) AUXILIARY LOADING DEVICE OF A STRETCHER

(71) Applicant: STEM S.R.L., Medesano (IT)

(72) Inventors: Ezio Menna, Collecchio (IT); Michele Corradi, Parma (IT)

(73) Assignee: STEM S.R.L., Medesano (IT)

( * ) Notice: Subject to any disclaimer, the term of this patent is extended or adjusted under 35 U.S.C. 154(b) by 231 days.

(21) Appl. No.: 16/243,240

(22) Filed: Jan. 9, 2019

(65) Prior Publication Data

US 2019/0216659 A1 Jul. 18, 2019

(30) Foreign Application Priority Data

Jan. 12, 2018 (IT) ..... 102018000000793
Jan. 12, 2018 (IT) ..... 102018000000812

(51) Int. Cl.
*A61G 3/02* (2006.01)
*B66D 1/12* (2006.01)
*A61G 3/06* (2006.01)

(52) U.S. Cl.
CPC ..... *A61G 3/029* (2013.01); *A61G 3/061* (2013.01); *B66D 1/12* (2013.01); *A61G 2203/10* (2013.01); *A61G 2203/32* (2013.01); *A61G 2203/40* (2013.01); *A61G 2203/70* (2013.01)

(58) Field of Classification Search
CPC .... A61G 3/029; A61G 3/0218; A61G 3/0875; A61G 2203/10; B66D 1/12; B66C 13/24; B66C 13/26
See application file for complete search history.

(56) References Cited

U.S. PATENT DOCUMENTS 9,676,481 B1 * 6/2017 Buchmueller ..... B64D 1/02
2004/0202533 A1 * 10/2004 Haire ..... B60P 1/6454 414/538
2011/0080016 A1 * 4/2011 Lambarth ..... A61G 3/0236 296/20
2012/0025157 A1 2/2012 Hoffend, III
2015/0352997 A1 12/2015 Ping-Chun

FOREIGN PATENT DOCUMENTS

DE 10305750 B3 6/2004
EP 0580392 A1 1/1994
JP 2011046513 A 3/2011
KR 20180010886 A 1/2018
WO 2013039408 A1 3/2013
WO 2017194964 A2 11/2017

* cited by examiner

*Primary Examiner* — Saul Rodriguez
*Assistant Examiner* — Willie Berry, Jr.
(74) *Attorney, Agent, or Firm* — Browdy and Neimark, PLLC

(57) ABSTRACT

An auxiliary loading device of a stretcher including a winch having a support frame rotatably supporting a spool, a tow strap wound on the spool and having a tow hook attachable to the stretcher, and a motor connected and configured to rotate the spool in a first direction for winding the tow strap on the spool and in a second direction for unwinding the tow strap from the spool. A sensor is connected to the winch to detect a value of a parameter indicative of a tension of a unwound section of the tow strap including the tow hook, and an electronic control unit operatively connected to the sensor unit and the motor of the winch to stop rotation of the spool when operated to rotate in the second direction if the value of the parameter indicative of the tension is less than or equal to a reference value.

11 Claims, 6 Drawing Sheets

AUXILIARY LOADING DEVICE OF A STRETCHER

TECHNICAL FIELD

The present invention relates to an auxiliary device for loading a stretcher onto loading planes.

More particularly, the invention relates to an auxiliary device for loading a stretcher onto loading planes, such as inclinable, to assist loading the stretcher on the loading plane, for example placed at a loading platform of an ambulance, and the unloading of the stretcher from the loading plane.

Prior Art

Known devices provide for the use of a winch driven by a motor, a strap wound on the winch and connectable to the stretcher and a device for operating the motor of the winch in the two rotation directions, according to the direction of loading or unloading to be imposed to the stretcher.

A need felt in known devices is to increase their safety, especially when unloading the stretcher along the inclined loading plane, or when the motor of the winch operates to allow the unwinding of the strap.

It has been observed, in fact, that if the stretcher, during its unloading stroke, for some reason stops its descent motion, for example due to a temporary stoppage due to an obstacle, the motor of the winch still continues to unwind the strap.

In this case, the stretcher, when the obstacle that caused the accidental stop of the stretcher is removed, suddenly and without control resumes its descent stroke until this stroke is suddenly interrupted by the binding reaction of the strap which returns in tension, with obvious disadvantages both for the user of the stretcher and for the staff responsible for loading/unloading the stretcher. In practice, if the obstacle was suddenly lost, the stretcher would fall violently due to the weight of the patient being transported and, therefore, it would fall to the ground without the operator being able to intervene to prevent it.

A further need felt in known devices is that of improving and speeding up the operations of installation and maintenance of the winch, in particular of the parts subject to wear and continuous maintenance thereof, such as for example the strap and/or the motor.

It is the object of the present invention to meet these needs of greater safety of the prior art with a simple, functional and cost-effective solution.

Yet another object is to provide an auxiliary device for loading a stretcher wherein the removal and/or replacement of the strap and/or the motor in case of need is made easy, fast and safe, for example during periodic maintenance interventions of the device to maintain the performance and the degree of safety thereof unchanged over time.

These objects are achieved by the features of the invention described in the independent claims. The dependent claims describe preferred and/or particularly advantageous aspects of the invention.

DESCRIPTION OF THE INVENTION

In particular, the invention provides an auxiliary loading device of a stretcher on a loading plane, for example fixed or removable, comprising:

- a winch which includes:
  - a support frame which rotatably supports a spool;
  - a tow strap wound on the spool and provided with a tow hook that can be attached to the stretcher; and
  - a motor connected to the spool and configured to rotate the spool, in a first rotation direction for winding the tow strap on the spool and in an opposite second rotation direction for unwinding the tow strap from the spool;

the auxiliary loading device further comprising:

- a sensor unit connected to the winch and configured to detect a value of a parameter indicative of a tension of a section of the tow strap comprising the tow hook and unwound from the spool; and
- an electronic control unit operatively connected to the sensor unit and to the motor of the winch, wherein the electronic control unit is configured to stop the rotation of the spool when operated to rotate in the second direction of rotation if the value of the parameter indicative of the tension detected by the sensor unit is less than or equal to a predetermined reference value thereof.

With this solution, if in case of accidental stop of the stretcher in its unloading stroke from the loading plane, the electronic control unit, as soon as the sensor unit detects a drop in tension on the section of tow strap unwound from the spool, immediately stops the tow strap unwinding, so as to be able to limit the free travel of the stretcher, when the cause of the accidental stop is removed.

In a preferred embodiment of the invention, the sensor unit may comprise:

- an arm movably connected to the support frame of the winch and provided with an appendage placed in contact with the section of the tow strap comprising the tow hook and unwound from the spool; and
- a proximity sensor configured to detect the position of the arm appendage, as a parameter indicative of the tension of the section of tow strap unwound from the spool (and comprising the tow hook); and the electronic control unit may in this case be configured to stop the rotation of the spool when it is rotated in the second direction of rotation on the basis of the position of the appendage of the arm detected by the proximity sensor.

In practice, the electronic control unit is configured to determine the value of the parameter indicative of the tension of the section of the tow strap comprising the tow hook and unwound from the spool on the basis of the position of the arm appendage detected by the proximity sensor, in other words, to determine if the tension of the section of the tow strap comprising the tow hook and unwound from the spool has fallen below its critical reference value (which defines the substantially non-tensioned tow strap) as a function of the position taken by the appendage of the arm.

In this way, the detection of the strap tension can be carried out simply, effectively and cost-effectively.

A further aspect of the invention may provide that the appendage of the arm may be movable with respect to a fixed point of the support frame from a position close to the fixed point to a position moved away from the fixed point in contrast to a thrust force.

In particular, the proximity sensor can be fixed to the fixed point of the support frame.

For example, the thrust force may be an elastic force determined by a spring interacting between the support frame and the arm.

With this solution, the sensor unit is particularly efficient and safe.

In one embodiment, the appendage of the arm may comprise a through loop within which the section of the tow strap comprising the tow hook and unwound from the spool is slidably inserted.

For example, the through loop can be delimited by two rollers rotatably associated with the appendage of the arm around rotation axes parallel to a rotation axis of the spool.

With this solution, the appendage can copy and follow the pattern of the tow strap in every position thereof, that is to be lowered by the tensioned tow strap and raised when the tow strap becomes loose.

In a possible embodiment, an abutment element of the proximity sensor can be fixed to the arm appendage.

With this solution, the proximity sensor can detect the position of the arm in a precise and repeatable manner.

For the same purposes described above, a further aspect of the invention provides a loading system for a stretcher which comprises:

a loading plane, for example fixed or removable, and an auxiliary loading device as described above, wherein the support frame of the winch is fixed in the vicinity of a top of the loading plane.

The loading system may for example comprise an ambulance provided with a loading platform, the loading plane being connected to the loading platform of the ambulance and the support frame of the winch being fixed to one between the loading platform of the ambulance and the loading plane.

Furthermore, for the same purposes as described above, a further aspect of the invention provides a method of controlling an auxiliary loading device of a stretcher on a loading plane, wherein the auxiliary loading device comprises a winch comprising: a support frame which rotatably supports a spool; a tow strap wound on the spool and provided with a tow hook that can be attached to the stretcher; and a motor connected to the spool and configured to rotate the spool, in a first rotation direction for winding the tow strap on the spool and in an opposite second rotation direction for unwinding the tow strap from the spool.

wherein the method provides for:

detecting a value of a parameter indicative of a tension of a section of the tow strap comprising the tow hook and unwound from the spool; and interrupting the rotation of the spool during its rotation in the second direction of rotation if the value of the parameter indicative of the tension detected is less than a predetermined reference value thereof.

A further aspect of the invention provides that the winch spool, which is rotatably supported by the support frame around a rotation axis, is provided with a housing seat eccentric with respect to the rotation axis of the spool and open at an outer jacket of the spool; and the tow strap is wound on the spool and is provided with a first end accommodated in the housing seat of the spool and a second end provided with a tow hook connected to the stretcher.

Advantageously, the spool can be formed by two opening half-shells and the housing seat can be defined between the two half-shells, so as to be also openable and closable.

With this solution, it is possible to carry out the operations of removing and/or replacing the tow strap from the spool in a quick, safe and fast manner.

Preferably, the housing seat may be configured to switch from a closed configuration, in which it retains the first end of the tow strap, and an open configuration, in which it releases the first end of the tow strap.

According to an aspect of the invention, the two half-shells can be joined together by means of disconnectable fixing members, such as bolts or the like.

With this solution, the temporary and disconnectable fixing of the half-shells is made particularly reliable and fast.

Advantageously, the two half-shells can be removably keyed on a central shaft supported by the support frame in a rotatable manner around the rotation axis; a prismatic connection is defined between the central shaft and the two half-shells.

With this solution, the transmission of the motion to the half-shells of the spool is made effective and functional.

In more detail, the above winch motor can be connected to the central shaft of the spool, for example directly or through appropriate transmissions or reductions.

In addition to what has been disclosed above, the invention, independently from above disclosed (namely with respect to the aforementioned control logic) and also claimable separately from what aforesaid, provides an auxiliary loading device of a stretcher on a loading plane, for example fixed or removable, wherein the auxiliary loading device comprises a winch provided with:

a support frame;

a spool supported by the support frame rotatably about a rotation axis and provided with an eccentric seat with respect to the rotation axis of the spool and open at an outer spool sleeve; and a tow strap wound on the spool and provided with a first end housed in the spool housing seat and a second end provided with a tow hook that can be attached to the stretcher;

wherein the spool is formed by two opening half-shells and the housing seat is defined between the two half-shells, so as to be also openable and closable.

With this solution, it is possible to carry out the operations of removing and/or replacing the tow strap from the spool in a quick, safe and fast manner.

Preferably, the housing seat may be configured to switch from a closed configuration, in which it retains the first end of the tow strap, and an open configuration, in which it releases the first end of the tow strap.

According to an aspect of the invention, the two half-shells can be joined together by means of disconnectable fixing members, such as bolts or the like.

With this solution, the temporary and disconnectable fixing of the half-shells is made particularly reliable and fast.

Advantageously, the two half-shells can be removably keyed on a central shaft supported by the support frame in a rotatable manner around the rotation axis; a prismatic—is defined between the central shaft and the two half-shells.

With this solution, the transmission of the motion to the half-shells of the spool is made effective and functional.

Advantageously, the winch of the auxiliary loading device according to the invention can comprise a motor connected to the spool and configured to rotate the spool, in a first rotation direction for winding the tow strap on the spool and in an opposite second rotation direction for unwinding the tow strap from the spool.

In more detail, the above winch motor can be connected to the central shaft of the spool, for example directly or through appropriate transmissions or reductions.

Yet another aspect of the invention provides that the auxiliary loading device may further comprise:

a sensor unit connected to the winch and configured to detect a value of a parameter indicative of a tension of a section of the tow strap comprising the tow hook and unwound from the spool; and an electronic control unit operatively connected to the sensor unit and to the motor of the winch, wherein the electronic control unit is configured to stop the rotation of the spool when operated to rotate in the second direction of rotation if the value of the parameter indicative of the tension detected by the sensor unit is less than or equal to a predetermined reference value thereof.

With this solution, if in case of accidental stop of the stretcher in its unloading stroke from the loading plane, the electronic control unit, as soon as the sensor unit detects a drop in tension on the section of tow strap unwound from the spool, immediately stops the tow strap unwinding, so as to be able to limit the free travel of the stretcher, when the cause of the accidental stop is removed.

In a preferred embodiment of the invention, the sensor unit may comprise:

an arm movably connected to the support frame of the winch and provided with an appendage placed in contact with the section of the tow strap comprising the tow hook and unwound from the spool; and a proximity sensor configured to detect the position of the arm appendage, as a parameter indicative of the tension of the section of tow strap unwound from the spool (and comprising the tow hook);

the electronic control unit may in this case be configured to stop the rotation of the spool when it is rotated in the second direction of rotation on the basis of the position of the appendage of the arm detected by the proximity sensor.

In practice, the electronic control unit is configured to determine the value of the parameter indicative of the tension of the section of the tow strap comprising the tow hook and unwound from the spool on the basis of the position of the arm appendage detected by the proximity sensor, in other words, to determine if the tension of the section of the tow strap comprising the tow hook and unwound from the spool has fallen below its critical reference value (which defines the substantially non-tensioned tow strap) as a function of the position taken by the appendage of the arm.

In this way, the detection of the strap tension can be carried out simply, effectively and cost-effectively.

A further aspect of the invention may provide that the appendage of the arm may be movable with respect to a fixed point of the support frame from a position close to the fixed point to a position moved away from the fixed point in contrast to a thrust force.

In particular, the proximity sensor can be fixed to the fixed point of the support frame.

For example, the thrust force may be an elastic force determined by a spring interacting between the support frame and the arm.

With this solution, the sensor unit is particularly efficient and safe.

In one embodiment, the appendage of the arm may comprise a through loop within which the section of the tow strap comprising the tow hook and unwound from the spool is slidably inserted.

For example, the through loop can be delimited by two rollers rotatably associated with the appendage of the arm around rotation axes parallel to a rotation axis of the spool.

With this solution, the appendage can copy and follow the pattern of the tow strap in every position thereof, that is to be lowered by the tensioned tow strap and raised when the tow strap becomes loose.

In a possible embodiment, an abutment element of the proximity sensor can be fixed to the arm appendage.

With this solution, the proximity sensor can detect the position of the arm in a precise and repeatable manner.

For the same purposes described above, a further aspect of the invention provides a loading system for a stretcher which comprises:

a loading plane, for example fixed or removable, and an auxiliary loading device as described above, wherein the support frame of the winch is fixed in the vicinity of a top of the loading plane.

The loading system for example comprises an ambulance provided with a loading platform, the loading plane being connected to the loading platform of the ambulance and the support frame of the winch being fixed to one between the loading platform of the ambulance and the loading plane.

Furthermore, for the same purposes as described above, a further aspect of the invention provides a method of controlling an auxiliary loading device of a stretcher on a loading plane, wherein the auxiliary loading device comprises a winch comprising: a support frame which rotatably supports a spool; a tow strap wound on the spool and provided with a tow hook that can be attached to the stretcher; and a motor connected to the spool and configured to rotate the spool, in a first rotation direction for winding the tow strap on the spool and in an opposite second rotation direction for unwinding the tow strap from the spool. wherein the method provides for:

detecting a value of a parameter indicative of a tension of a section of the tow strap comprising the tow hook and unwound from the spool; and interrupting the rotation of the spool during its rotation in the second direction of rotation if the value of the parameter indicative of the tension detected is less than a predetermined reference value thereof.

BRIEF DESCRIPTION OF THE FIGURES

Further features and advantages of the invention will become apparent from the following description, provided by way of non-limiting example with the aid of the figures shown in the accompanying drawings.

BEST MODE OF CARRYING OUT THE INVENTION

Figure 1:
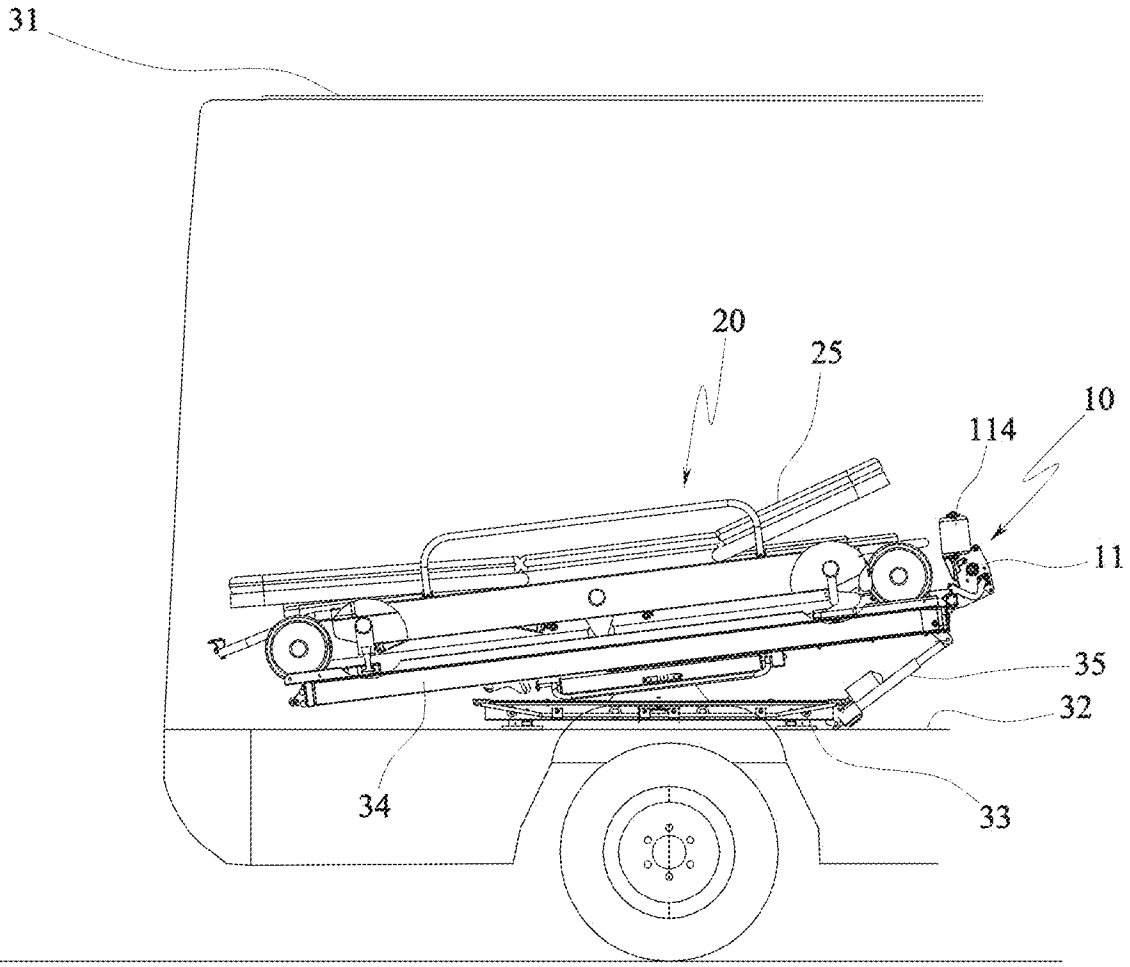
FIG. 1 is a schematic view of an ambulance provided with an auxiliary loading device according to the invention.

With particular reference to the above figures, reference numeral 10 generally indicates an auxiliary loading device for stretchers 20 suitable for loading a stretcher 20 on a loading plane 30 and unloading the stretcher 20 from the same loading plane 30, for example assisting the loading and unloading operations carried out by a specialized operator (anyway present).

The stretcher 20 generically comprises a support table, indicated as a whole with reference numeral 21, which is adapted to receive and support a patient in a substantially lying position.

Figure 2:
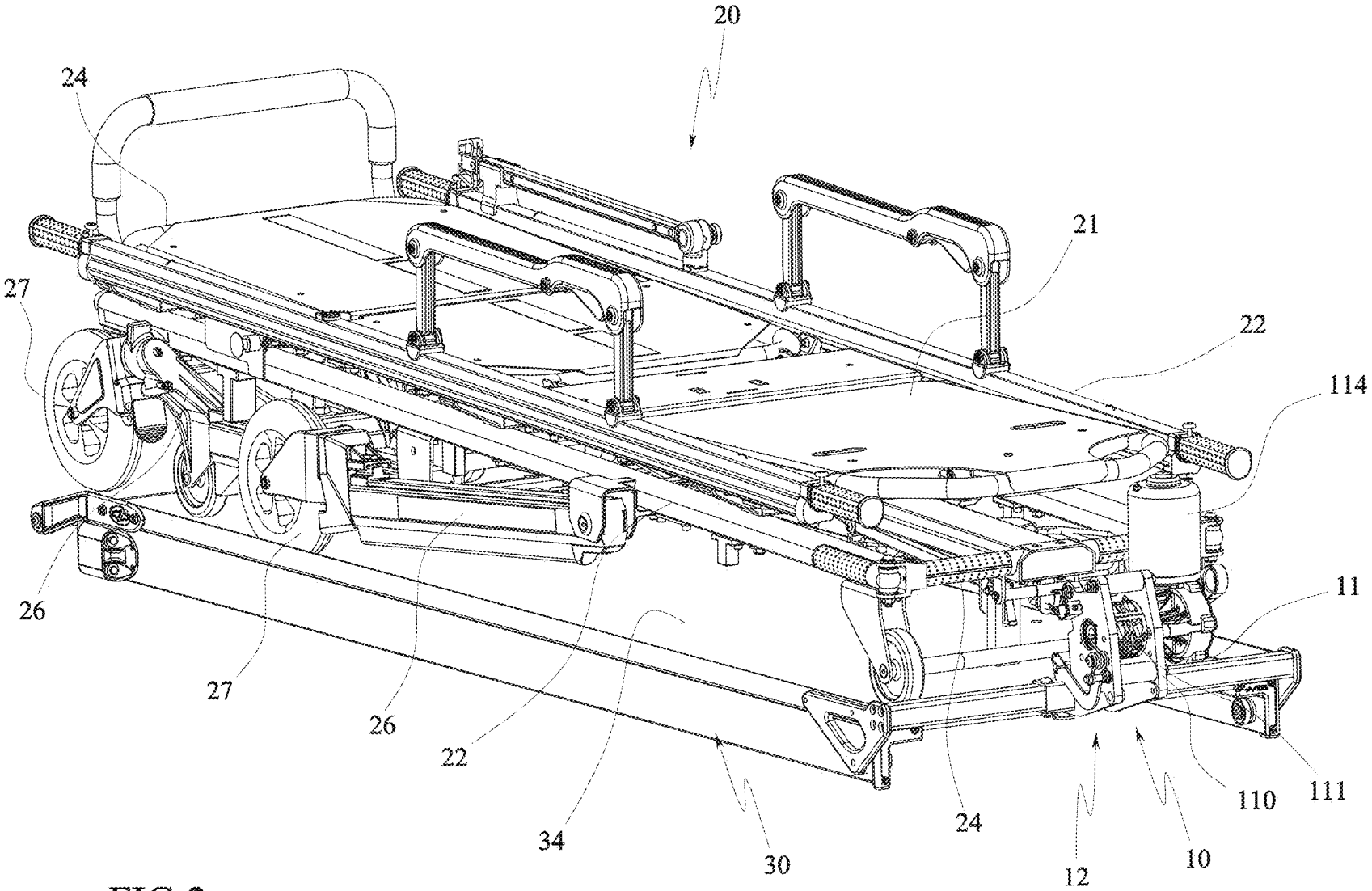
FIG. 2 is an axonometric view of a stretcher loaded on an auxiliary loading device according to the invention.

As shown in FIGS. 1 and 2, said support table 21 comprises a frame of substantially rectangular plane shape, which comprises two parallel longitudinal rods 22 joined at the ends by as many transverse rods 24, respectively rear (or arranged on the side of the feet of the user of the stretcher 20) and front (or arranged on the side of the head of the user of the stretcher 20).

The rear transverse rod 24 provides a handle adapted to be gripped with both hands by an operator, for pushing and guiding the stretcher 20 in motion.

The support table 21 is normally covered by a bed 25, which is arranged longitudinally and is fixed on the support table 21.

In particular, said bed 25 comprises three mutually connected flat portions, which can be articulated according to transverse articulation axes, so as to be able to modify their inclination, in order to more comfortably accommodate the patient to be transported.

The bed 25 is further covered by a soft flexible mattress, which is adapted to make the support for the patient more comfortable.

The support table 21 is associated with (two) support legs 26, which are adapted to be in contact with the surface on which the stretcher 20 is supported.

Said support legs 26 are individually connected to the support table 21 so as to be able to move independently of one another between a respective closed position and a respective open position.

When both support legs 26 are in their respective open position, they support the support table 21 at a maximum height from the support surface (ground); when both support legs 26 are in their respective closed position of FIGS. 1 and 2, they support the support table 21 at a minimum height from the supporting surface.

At the distal end from the support table 21 of each support leg 26, at least one wheel 27 is rotatably coupled, for example pivoting, resting and rolling on the support surface of the stretcher 20.

The stretcher 20 can be of any known type.

The loading plane 30 is generally mounted on board a rescue vehicle, in this case on board an ambulance 31, which comprises a loading platform 32 arranged at the bottom of a (rear) loading compartment open at the rear and adapted to accommodate the stretcher 20, for the transport thereof.

The loading plane 30, for example, schematically comprises a support base 33 fixed to the loading platform 32 of the ambulance 31, and an inclinable plane 34 connected to said support base 33 via at least one articulation, which allows it to lean towards to the plane defined by the loading platform 32 of the ambulance 31. In particular, the inclinable plane 34 is inclinable between a rest position, in which the inclinable plane 34 is substantially horizontal (or in any case parallel to the loading platform 32 of the ambulance 31), and an operating position (used for loading on ambulances), in which the front end of the inclinable plane 34 (i.e. that proximal to the front portion of the ambulance 31) is located at a level higher than the rear end of the inclinable plane 34, for example (for certain application circumstances indicated only as non-limiting example), the maximum inclination of the inclinable plane 34 between the rest position and the operating position is 16° (sexagesimal degrees).

The inclination of the inclinable plane 34 is variable and is, for example, controlled by an electric jack 35, as is known to the man skilled in the art, or another known actuator.

The loading plane 30 can be of any known type also, for example fixed or removable.

The auxiliary loading device 10 comprises a winch 11, which comprises a support frame 110, for example defined by two lateral sides joined together by support cross members; the support frame 110 is integrally fixed, for example by bolted brackets, to at least one between the loading platform 32 of the ambulance 31 and the loading plane 30, in particular to the inclinable plane 34, in the proximity of the top portion (or front end) of the inclinable plane 34.

In the example shown in the figures, the support frame 110 of the winch 11 is fixed to the front end of the inclinable plane (directly), for example in a central area thereof.

The support frame 110 rotatably supports a spool 111 arranged with a rotation axis substantially parallel to the inclinable plane 34 and orthogonal to the longitudinal axis thereof (i.e. parallel to the axle of the rear wheels of the ambulance 31).

The spool 111 has two end pins rotatably coupled in respective seats formed in the side edges of the support frame 110.

Spool 111 is fixed, in known manner, to a first end of a tow strap 112 adapted to be wound on the spool 111 and unwound from the spool 111 by effect of the rotation of the spool 111 about its rotation axis.

A tow strap 112 refers herein to any flexible member, for example substantially inextensible, such as for example a belt, a chain, a rope or similar flexible members.

The tow strap 112 in this case is provided with a tow hook 113 (see FIGS. 3 and 4), for example of the carabiner type, which is placed at a second end of the tow strap 112 (opposite to the first end thereof which is bound to the spool 111).

The tow hook 113 can be releasably coupled to the stretcher 20—in particular to a front transverse rod 24 thereof—for towing it.

It is noted that in the following description, reference will be made to the towing, upwards and downwards from the inclinable plane 34, of a stretcher 20 (which carries or does not carry the user thereof).

According to an aspect of the invention, the spool 111 comprises a central shaft 1110, for example prismatic, in the example with a quadrangular base (square in more detail), from the opposed ends whereof protrude said end pins.

In detail, the central shaft 1110 is keyed on a coaxial (cylindrical) shaft whose longitudinal ends projecting from the central shaft 1110 (which define the above end pins) are coupled to the side edges of the support frame 110, for example by interposition of suitable bearings.

The central axis of the central shaft 1110 (that is, the coaxial cylindrical shaft) defines the rotation axis A of the spool 111.

Moreover, the spool 111 comprises a revolution body, for example cylindrical, which is formed (or consists of) two (or more) half-shells 1111 which can be opened, for example substantially semi-cylindrical, which are joined in a disconnectable manner by fastening members, such as bolts 1112.

Alternatively or in addition, the fastening members may be of the hinge type or other fastening member suitable for allowing the mutual temporary/disconnectable fixing of the half-shells 1111.

In the example, the two half-shells 1111 have, once joined together, a substantially cylindrical outer jacket (coaxial with respect to the rotation axis A) on which the tow strap 112 can be wound.

The outer jacket is, in practice, defined by the union of two semi-cylindrical outer jackets respectively of the two half-shells 1111.

Each half-shell 1111 can have a plurality of lightening (radial) holes.

Each half-shell 1111 comprises, at an inner face intended to be facing (and placed substantially in contact with) the other half-shell 111, a prismatic half-housing 1113 adapted to receive, substantially to measure, a respective portion of the central shaft 1110 and define a prismatic connection therewith (or in any case a constraint with respect to the axial rotation).

In practice, when the half-shells 1111 are joined together (by tightening the bolts 1112), they surround the central shaft 1110, so that the prismatic half-housings 1113 receive to measure and tighten themselves in a vice on the central shaft 1110.

Each half-shell 1111 comprises, at an inner face intended to face towards the other half-shell 111, a seating half-housing 1114, for example substantially semi-cylindrical and positioned eccentrically with respect to the rotation axis A of the spool 111, or the respective half-shell 1111.

Each seating half-housing 1114 is placed at one end of the inner face of the respective half-shell 1111 and connects with an end section of the respective outer jacket.

In practice, when the half-shells 1111 are joined together (by tightening the bolts 1112), the seating half-housing 1114 face each other to define a housing (substantially cylindrical) open at an outer jacket of the spool 111.

The above seat, defined by the union of the two seating half-housings 1114, surrounds a cylindrical (rigid) pin on which the first end of the tow strap 112 is wound, so that the tow strap 112 protrudes from the opening of the seat and the cylindrical pin remains firmly therein.

Figure 9:
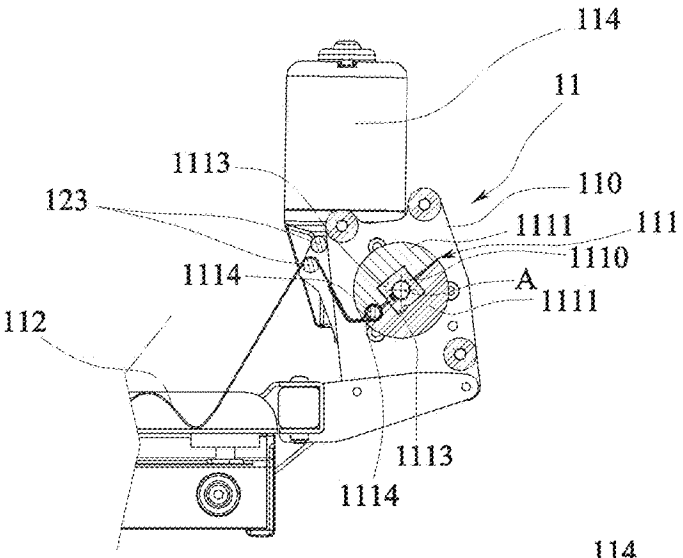
FIG. 9 is a view in a second lateral section of FIG. 4.
Figure 8:
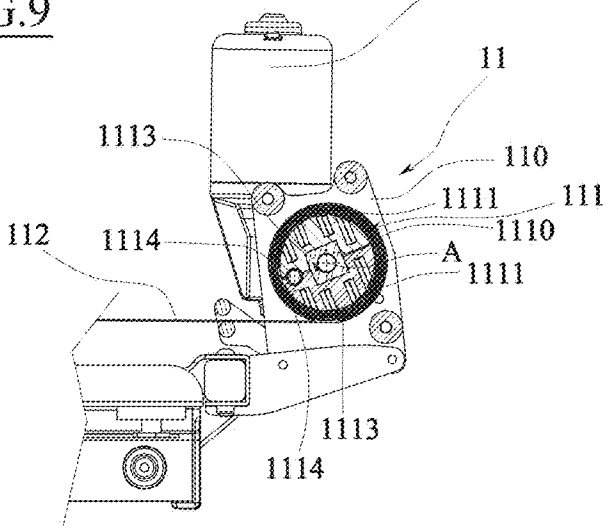
FIG. 8 is a view in a second lateral section of FIG. 3.
Figure 7:
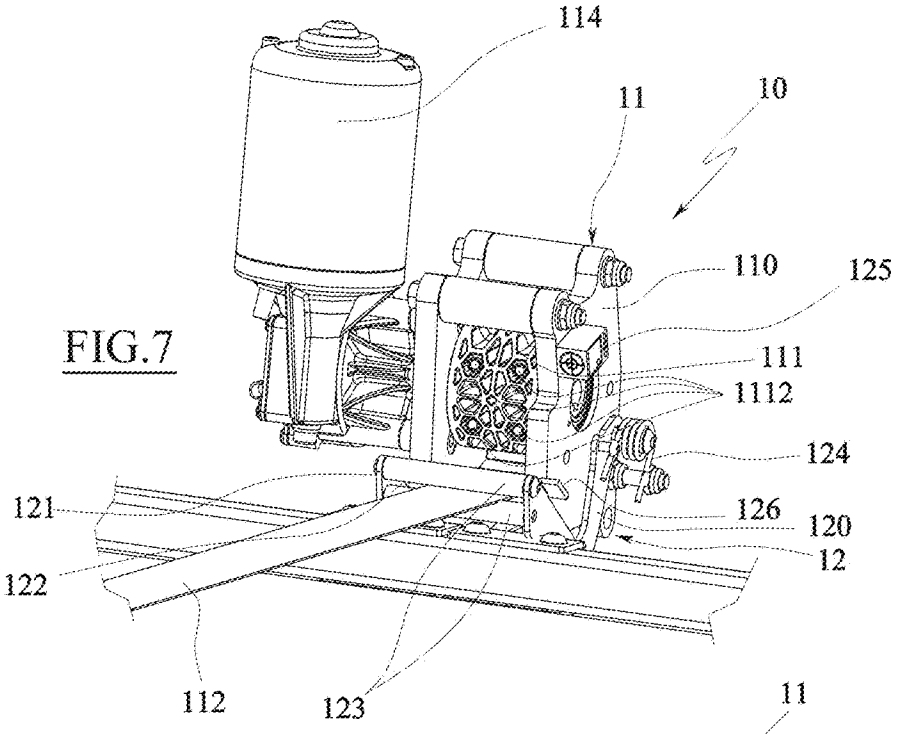
FIG. 7 is a view of a detail in FIG. 3.
Figure 10:
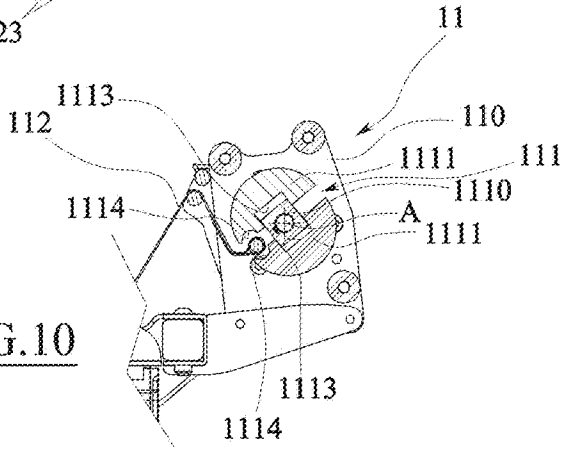
FIG. 10 is a partially exploded view of FIG. 9.

The seat is therefore defined between the two half-shells 1111, which being openable/closable (by means of said disconnectable fixing members), is configured to switch from a closed configuration (see FIGS. 9 and 10), in which it retains the first end (i.e. the cylindrical pin) of the tow strap 112 in a stable manner (preventing the extraction thereof), and an open configuration (see FIG. 10), in which it releases the first end of the tow strap 112, or allows the extraction thereof for removal and/or replacement thereof from the spool 111.

When the seat is in a closed configuration, in fact, the opening defined between the two seating half-housings 1114 has a width (in circumferential direction) smaller than the diameter of the cylindrical pin so as to prevent the extraction thereof.

In practice, to bring the seat into its open configuration it is sufficient to loosen the bolts 1112 and move the two half-shells 1111 apart, actually dividing the two seating half-housings 1114, on the contrary, to bring the seat into its closed configuration, it is sufficient to tighten the bolts 1112 and bring the two half-shells 1111 close together, effectively tightening the two seating half-housings 1114 around the cylindrical pin of the first end of the tow strap 112.

To replace or otherwise remove the tow strap 112 from the winch 11, it is sufficient, therefore, to unwind the tow strap 112 from the spool 111, bring the seat (and therefore the spool 111 itself) into its open configuration and remove the first end of the tow strap 112 from the engagement with the seat. Once the old tow strap 112 has been removed, a first end of a new tow strap 112 may be accommodated and tightened in the seat which can then be returned to its closed configuration to make the spool 111 operational again. The winch 11 further comprises a motor 114 (electric) provided with a drive shaft (not shown) connected directly or by means of suitable transmission and/or reduction elements (for example a gearbox), to the spool 111 (i.e. to one of the end pins thereof).

The motor 114 is configured to rotate the spool 111 in rotation in the two directions of rotation about its rotation axis, in particular, the actuation in rotation of the spool 111 in a first direction of rotation carries out the winding of the tow strap 112 on the spool 111 and the actuation in rotation of the spool 111 in an opposite second direction of rotation carries out the unwinding of the tow strap 112 from the spool 111.

In particular, the motor 114 (or the reducer connected thereto) has an output shaft (not shown) which is connected to one of the end pins of the central shaft 1110 for the actuation in rotation of the spool 111. The motor 114 is further supported (by means of suitable bolts) to a side edge of the support frame 110.

The passage of the spool 111 from the closed configuration to the open configuration also allows easy mounting/dismounting of the motor to/from the support frame 110, for example allowing easy access to the above bolts, which remain at least partially hidden during normal use of the winch 11.

The motor 114 can be electrically powered by a battery (not visible) placed on the motor itself or by a battery of the ambulance 31, for example by suitable wiring (not shown) or by a hydraulic motor driven by a hydraulic pump. The auxiliary loading device 10 in particular comprises a sensor unit 12 connected to the winch 11 and configured to detect a value of a parameter indicative of a tension of a section of the tow strap 112 comprising the tow hook 113 and unwound from the spool 111.

By tension of the section of the tow strap 112 comprising the tow hook 113 and unwound from the spool 111, it is meant herein the pulling force exerted by a weight (usually the stretcher 20) in the direction which tends to unwind the tow strap 112 from the spool 111.

In particular, the sensor unit 12 comprises an arm 120 movably connected to the support frame 110 of the winch 11, for example to one of the side edges thereof.

The arm 120, in the illustrated example, is pivotally coupled to the support frame 110 with respect to an oscillation axis parallel to the rotation axis of the spool 111 and, for example, eccentric (and lower) with respect thereto, preferably arranged in the proximity of one end (bottom) of the arm 120 itself.

The arm 120 is also provided with an appendage 121 defining, for example, the end of the arm 120 opposed to the one constrained to the support frame 110, which extends in a direction parallel to the axis of the spool 111 from the arm 120.

The appendage 121, in practice, is adapted to be in contact with the section of the tow strap 112 comprising the tow hook 113 and unwound from the spool 111.

More in detail, the appendage 121 of the arm 120 comprises a through loop 122 within which the section of tow strap 112 comprising the tow hook 113 and unwound from the spool 111 is slidably inserted.

The through loop 122 is dimensioned so that the tow hook 113 cannot pass therethrough, or may define an end of stroke element (in winding) for the tow strap 112.

In the example, the through loop 122 is delimited by two rollers 123 rotatably associated with the appendage 121 of the arm 120 around rotation axes parallel to the rotation axis of the spool 111.

Figure 3:
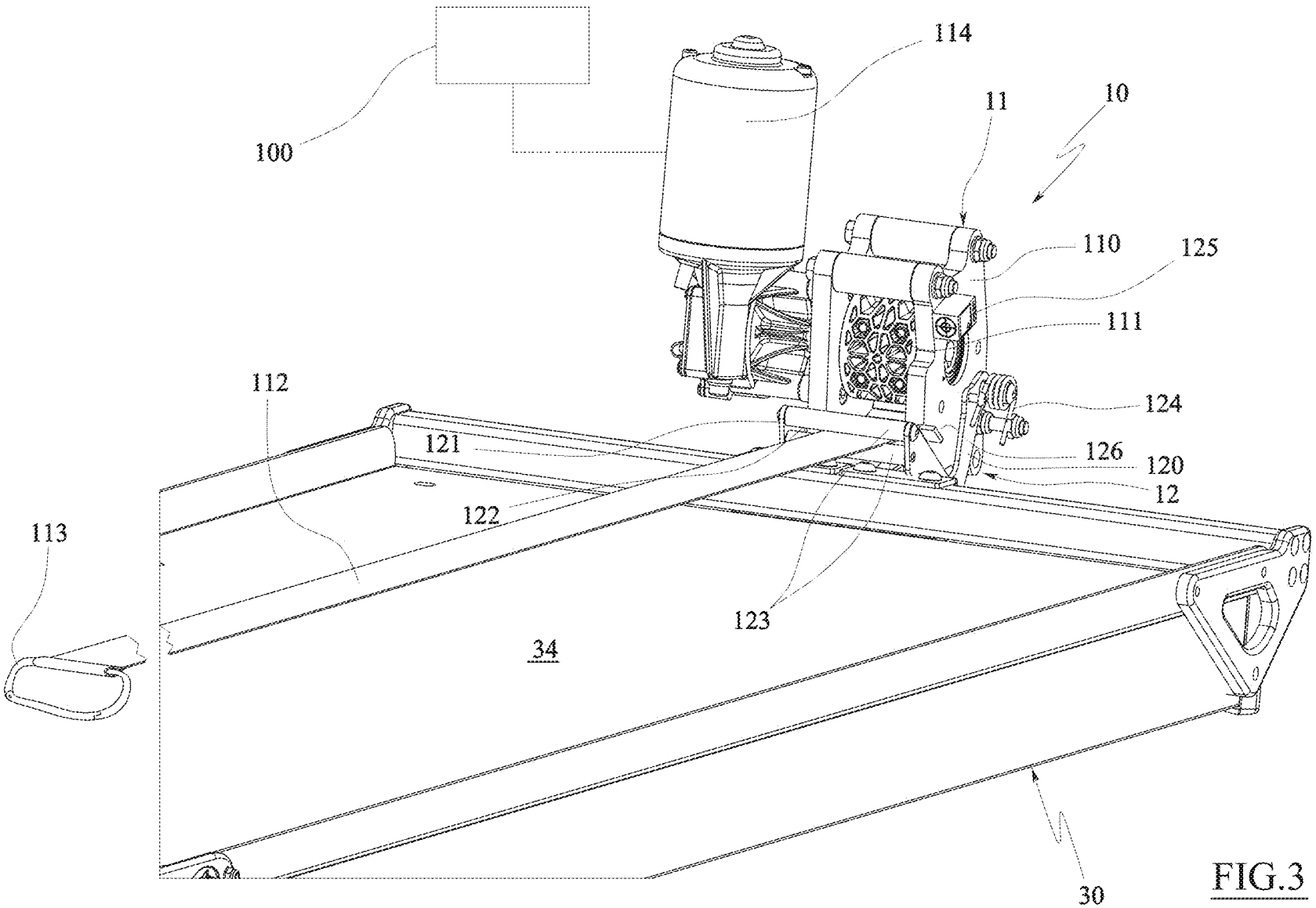
FIG. 3 is an axonometric view of a detail of the auxiliary loading device according to the invention with the tow strap in a tensioned configuration.
Figure 4:
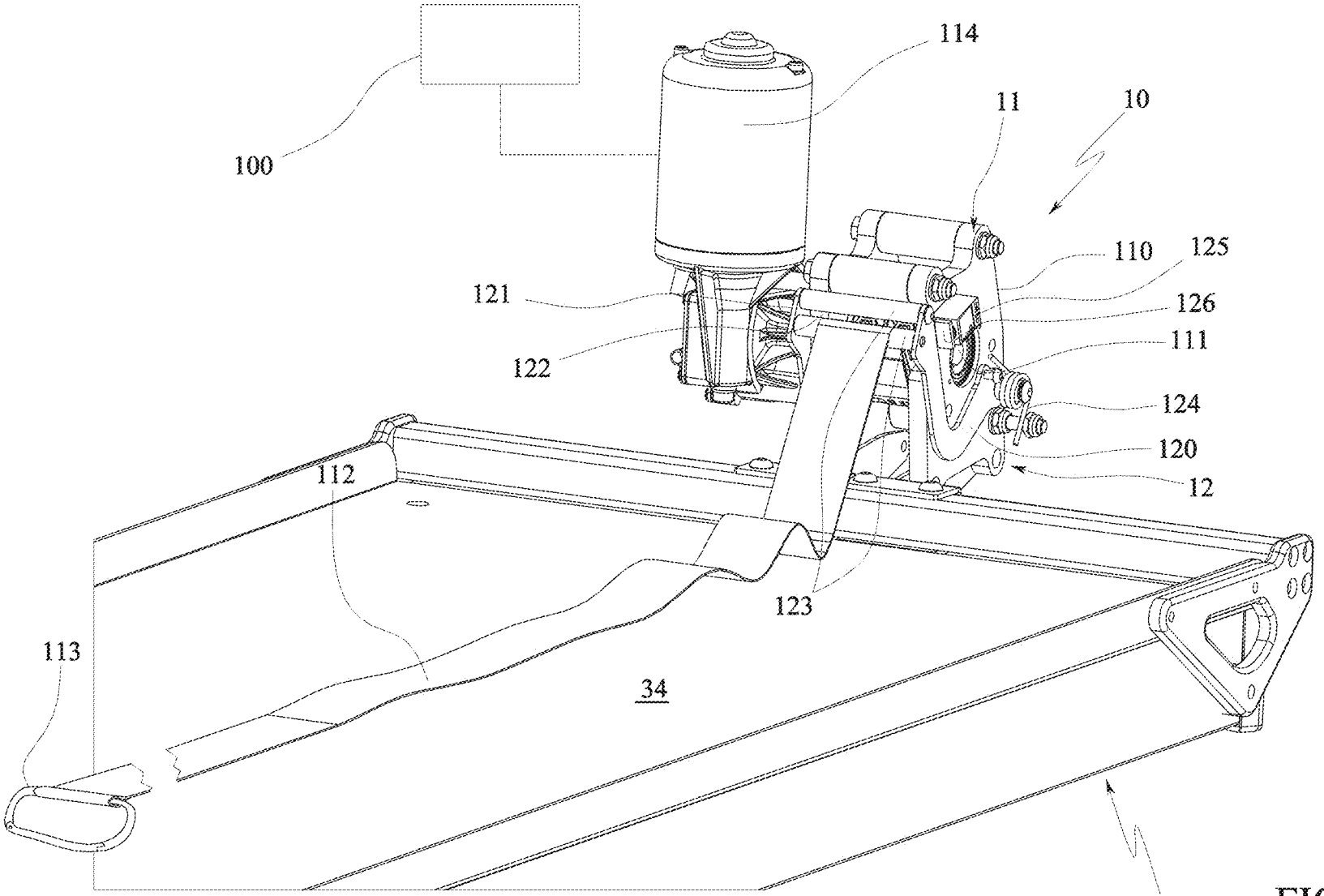
FIG. 4 is an axonometric view of a detail of the auxiliary loading device according to the invention with the tow strap in a loose configuration.
Figure 6:
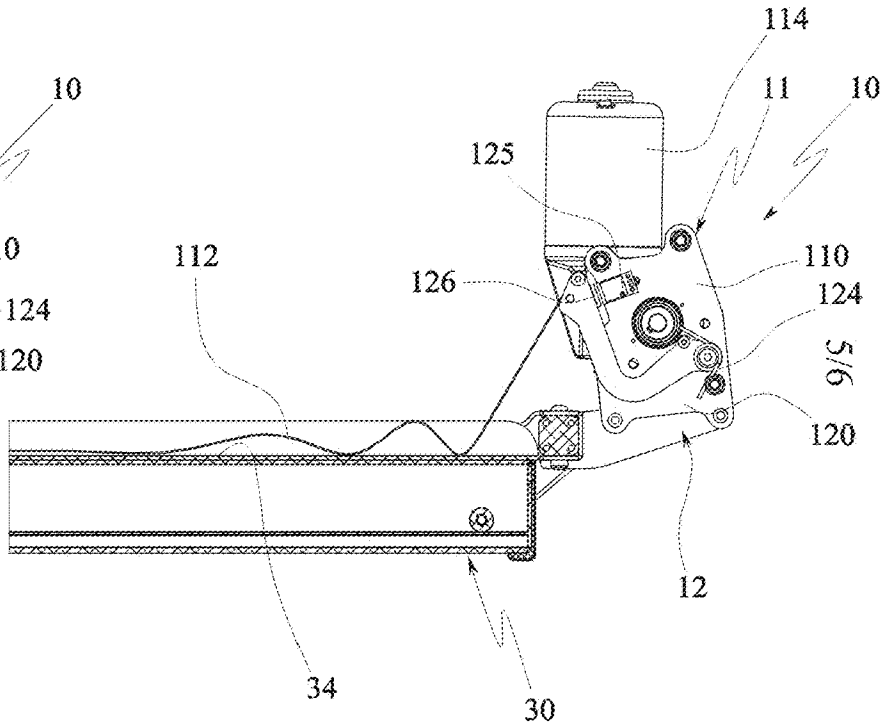
FIG. 6 is a view in a first lateral section of FIG. 4.
Figure 5:
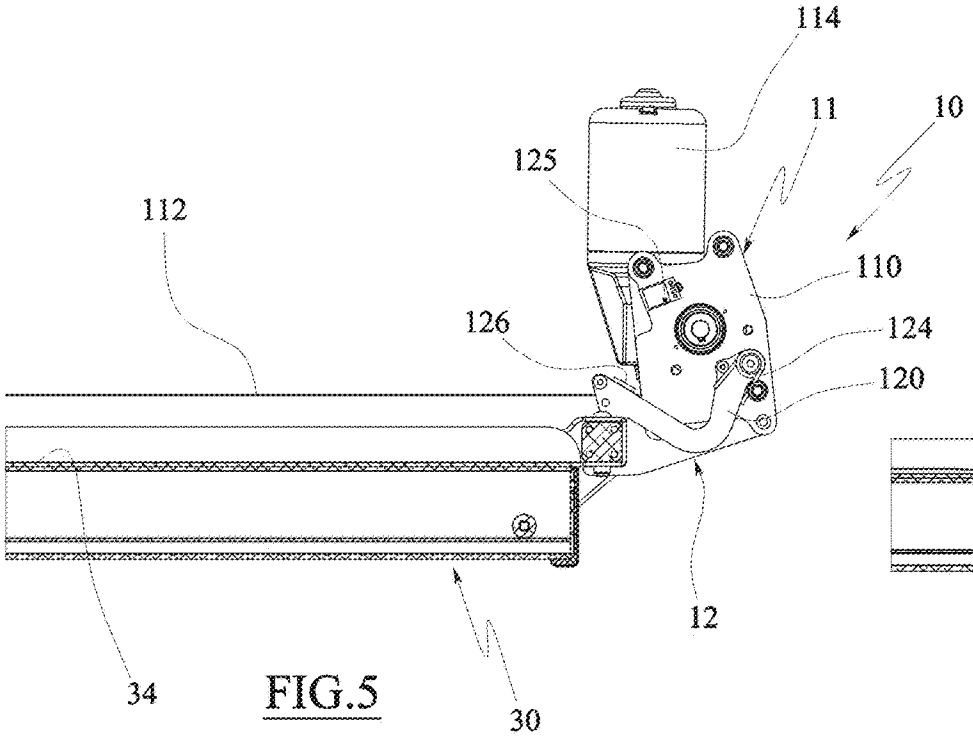
FIG. 5 is a view in a first lateral section of FIG. 3.

The appendage 121 of the arm 120 is movable (in oscillation) with respect to a fixed (upper) point of the support frame 110, which is placed on the arc of oscillation of the appendage itself, between a position close to the fixed point (see FIGS. 4 and 6) and a position away from it (see FIGS. 3 and 5).

In the position close to the fixed point, the appendage 121 is, for example, substantially in contact with an end of stroke portion defined by the support frame 110.

In particular, the appendage 121 of the arm 120, or the arm itself, is movable (in oscillation) from the position approached to the fixed point of the support frame 110 towards the position away from the fixed point in contrast to a predetermined thrust force, for example elastic (or magnetic or other).

In the example shown, the thrust force is exerted by a spring 124 interacting between the support frame 110 and the arm 120.

More in detail, the spring 124 is a torsion spring, defined for example by an elastic sheet wound on one or more coils coaxially fitted on the oscillation axis of the arm 120 and provided with opposed ends adapted to be circumferentially compressed between two abutment pins, of which a movable pin, fixed to the arm 120 in an eccentric position with respect to the oscillation axis thereof, and a fixed pin fixed to the support frame 110, or to the side edge thereof to which the arm 120 is connected.

It is not excluded that the spring 124 may be, alternatively or in addition, a compression spring or a bending spring according to the constructional requirements.

The spring 124, in practice, forcibly pushes the arm 120 (and therefore its appendage 122) towards the approached position, which is—therefore—in a stable balance position in this approached position.

The sensor unit 12 further comprises a proximity sensor 125 configured to detect the position of the appendage 121 of the arm 120, for example fixed to the support frame 110, or to the side edge to which the arm 120 is connected, preferably in proximity of/at the above fixed point.

In practice, the position of the appendage 121, which is always in contact with a section of the tow strap 112, is a parameter indicative of the tension of the section of the tow strap 112 itself.

The proximity sensor 125 is adapted to detect a distance of the appendage 121, or of an abutment element 126 (i.e. a metal plate) of the proximity sensor 125 which is fixed to the appendage 121 of the arm 120, in practice detecting if the appendage 121 is in its approached position or in a removed position.

In practice, the proximity sensor is adapted to emit a first signal, when the appendage 121 is in its approached position, and a second different signal when the appendage 121 is in its removed position.

The proximity sensor 125 can be electrically powered by the same battery that electrically powers the motor 114.

The auxiliary loading device 10 then comprises an electronic control unit 100, which is operatively connected to the sensor unit 12, in particular to the proximity sensor 125, and to the motor 114 of the winch 11 to control the motor 114 on the base of the measurements made by the sensor unit 12.

The electronic control unit 100 can be arranged on board of the winch 11 and/or of the ambulance 31 and connected, in wireless or wired mode, to the motor 114 and/or to the sensor unit 12.

In particular, the electronic control unit 100 is configured to stop the rotation of the spool 111 when it is controlled by the motor 114 in the second direction of rotation (unwinding of the tow strap 112) if the tension in the section of the tow strap 112 comprising the tow hook 113 and unwound from the spool 111 is less than or equal to a predetermined reference value thereof, for example it is equal to or close to zero.

In practice, the electronic control unit 100 is operatively connected to the motor 114 (or geared motor), so that the motor 114 can be selectively actuated, to operate the spool 111 in rotation, by controlling the power supply (or hydraulic or other type of energy) thereto and stopped, to stop the rotation of the spool 111, by interrupting the power supply of electric energy (or hydraulic or other type of energy).

More particularly, the electronic control unit 100 is configured to determine or estimate the value of the tension of the section of the tow strap 112 comprising the tow hook 113 and unwound from the spool 111 on the basis of the position of the appendage 121, or of the abutment element 126, of the arm 120 detected by the proximity sensor 125.

In practice, the electronic control unit 100 is set to assume the reference value of the tension equal to 0 when the proximity sensor 125 identifies the approached position (or a predetermined position that approximates the approached position) of the appendage 121 of the arm 12, i.e. when the proximity sensor emits the above first signal.

In practice, electronic control unit 100 is configured for:

allowing the motor 114 to be actuated in the second direction of rotation (unwinding of the tow strap 112) when the appendage 121 is in a removed position (or in a surrounding thereof), i.e. when the proximity sensor emits the above second signal, this position of the appendage is in fact indicative of the fact that the section of tow strap 112 comprising the tow hook 113 and unwound from the spool 111 is in a state of sufficient tension; and interrupting the rotation imparted by the motor 114 to the spool 111 when operated in such a second direction of rotation, when the appendage 121 is in its approached position or in a predetermined surrounding thereof, indicative of the fact that the section of tow strap 112 including the tow hook 113 and unwound from the spool 111 is in a state of insufficient or nonexistent tension.

In light of the foregoing, the operation of the auxiliary loading device 10 is as follows.

When loading the stretcher 20 on the inclinable plane 34, it is sufficient to hook the tow hook 13 of the tow strap 12, previously unwound from the spool 111 of the winch 11, to the front transverse rod 24 of the stretcher 20 and actuate, for example by means of a control push-button of the motor 114, the rotation of the spool 111 in the first rotation direction thereof, so as to cause the tow strap 112 to wind around the spool 11 and, therefore, the upward pulling of the stretcher 20 along the inclinable plane 34.

Conversely, in order to proceed with the unloading operations of the stretcher 20, the rotation of the spool 111 is carried out, for example by means of the control panel of the motor 114, in the opposite second rotation direction thereof so as to cause the unwinding of the tow strap 112 with respect to the spool 11 and, therefore, the controlled downward towing of the stretcher 20 along the inclinable plane 34, i.e. keeping the tow strap 112 tensioned so that it can act as a guide/limitation of the gravitational thrust acting on the stretcher 20 along the descent on the inclinable plane 34.

If, for any accidental reason, an obstacle interrupts the descent of the stretcher 20 along the inclinable plane 34 in the aforementioned unloading operations, then the sensor unit 12, together with the electronic control unit 100, intervenes as described below.

In particular, the sensor unit 12, immediately sensing a drop (or zeroing) of the tension on the section of the tow strap 112 comprising the tow hook 113 and unwound from the spool 111 (or axially interposed between the stretcher 20 and the spool 111), signals this drop to the electronic control unit 100 and it immediately stops, by stopping the motor 114, the rotation of the spool 111, that is, the unwinding of the tow strap 112.

In particular, the proximity sensor 125 detects in fact an (instantaneous) movement of the appendage 121 of the arm 120 (or of the abutment element 126) from the removed position to the approached position (due to the force of the spring 124) and therefore, the electronic control unit 100 commands the stopping of the motor 114, that is, the rotation of the spool 111 in the second direction of rotation, and therefore the further unwinding of the tow strap 112, when the position of the appendage 121 is near or arrives at the approached position.

Optionally, the electronic control unit 100 can be configured such that, when the motor 114 is stopped as described above, it can command a re-winding of a predetermined amount of the tow strap 112 (for example, by actuating the rotation of the spool 111 in the first rotation direction), so as to recover a quantity of traction on the section of tow strap 112 previously made loose by the interruption of the descent of the stretcher 20.

The downward stroke of the stretcher 20 can be continued only if an operator, having previously removed the cause of the obstacle, gives an explicit consent, for example by means of the control panel, to the electronic control unit 100 which, therefore, commands the actuation of the motor 114 in the second direction of rotation thereof.

The invention thus conceived is susceptible to numerous modifications and variations, all of which are within the scope of the inventive concept.

Moreover, all details can be replaced with other technically equivalent elements.

In practice, the materials used as well as the shapes and sizes may be any according to the requirements, without departing from the protection scope of the following claims.

The invention claimed is:

1. An auxiliary loading device of a stretcher on a loading surface comprising:

a winch including a support frame rotatably supporting a spool, a tow strap wound on the spool and provided with a tow hook configured to be attached to the stretcher, and a motor connected to the spool and configured to rotate the spool in a first rotation direction for winding the tow strap on the spool and in an opposite second rotation direction for unwinding the tow strap from the spool;

a sensor unit connected to the winch and configured to detect a value of a parameter indicative of a tension of a section of the tow strap comprising the tow hook and unwound from the spool; and an electronic control unit operatively connected to the sensor unit and the motor of the winch, wherein the electronic control unit is configured to stop the rotation of the spool when the spool is being operated to rotate in the second direction of rotation if the value of the parameter indicative of the tension detected by the sensor unit is less than or equal to a predetermined minimum reference value thereof.

2. The auxiliary load device according to claim 1, wherein the sensor unit comprises:

an aim movably connected to the support frame of the winch and provided with an appendage placed in contact with the section of the tow strap comprising the tow hook and unwound from the spool; and a proximity sensor configured to detect a position of the appendage of the aim as a parameter indicative of the tension detected by the sensor unit; and the electronic control unit being configured to stop the rotation of the spool when operated to rotate in the second direction of rotation on the basis of the position of the appendage of the aim detected by the proximity sensor.

3. The auxiliary loading device according to claim 2, wherein the appendage of the arm is movable with respect to a fixed point of the support frame from a position close to the fixed point to a position moved away from the fixed point in contrast to a thrust force.

4. The auxiliary load device according to claim 3, wherein the proximity sensor is fixed to the fixed point of the support frame.

5. The auxiliary loading device according to claim 2, wherein the thrust force is an elastic force determined by a spring interacting between the support frame and the arm.

6. The auxiliary loading device according to claim 2, wherein the appendage of the arm comprises a through loop within which the section of tow strap comprising the tow hook is slidably inserted and unwound from the spool.

7. The auxiliary loading device according to claim 6, wherein the through loop is delimited by two rollers rotatably associated with the appendage of the arm around rotation axes parallel to a rotation axis of the spool.

8. The auxiliary loading device according to claim 2, wherein an abutment element of the proximity sensor is fixed to the appendage of the arm.

9. A loading system of a stretcher which comprises:

a loading plane and an auxiliary loading device according to claim 1 wherein the support frame of the winch is fixed in the vicinity of a top of the loading plane.

10. The loading system according to claim 9, which further comprises an ambulance provided with a loading platform, the loading plane being connected to the loading platform of the ambulance and the support frame of the winch being fixed to one between the loading platform of the ambulance and the loading plane.

11. A method of controlling an auxiliary loading device of a stretcher on a loading plane, wherein the auxiliary loading device comprises a winch comprising: a support frame which rotatably supports a spool; a tow strap wound on the spool and provided with a tow hook that can be attached to the stretcher; and a motor connected to the spool and configured to rotate the spool, in a first rotation direction for winding the tow strap on the spool and in an opposite second rotation direction for unwinding the tow strap from the spool, respectively, wherein the method comprises:

detecting a value of a parameter indicative of a tension of a section of the tow strap comprising the tow hook and unwound from the spool; and interrupting the rotation of the spool during rotation of the spool in the second direction of rotation if the value of the parameter indicative of the tension detected is less than a predetermined minimum reference value thereof.

* * * * *